US012084995B2

(12) United States Patent
Johnson et al.

(10) Patent No.: US 12,084,995 B2
(45) Date of Patent: Sep. 10, 2024

(54) AIR INTAKE FOR A LEAN-BURN GASOLINE ENGINE

(71) Applicant: JAGUAR LAND ROVER LIMITED, Warwickshire (GB)

(72) Inventors: Jack Johnson, Coventry (GB); Lyn McWilliam, Coventry (GB)

(73) Assignee: JAGUAR LAND ROVER LIMITED, Coventry (GB)

( * ) Notice: Subject to any disclaimer, the term of this patent is extended or adjusted under 35 U.S.C. 154(b) by 0 days.

(21) Appl. No.: 18/551,640

(22) PCT Filed: Mar. 26, 2021

(86) PCT No.: PCT/EP2021/057940
§ 371 (c)(1),
(2) Date: Sep. 21, 2023

(87) PCT Pub. No.: WO2022/199846
PCT Pub. Date: Sep. 29, 2022

(65) Prior Publication Data

US 2024/0035399 A1 Feb. 1, 2024

(51) Int. Cl.
*F01L 3/20* (2006.01)
*F01L 3/22* (2006.01)

(52) U.S. Cl.
CPC .. *F01L 3/20* (2013.01); *F01L 3/22* (2013.01)

(58) Field of Classification Search
CPC ..... F01L 3/20; F01L 3/22
See application file for complete search history.

(56) References Cited

U.S. PATENT DOCUMENTS

| | | | | |
|---|---|---|---|---|
| 5,195,488 | A | 3/1993 | Rattigan | |
| 5,634,444 | A | 6/1997 | Matsuki et al. | |
| 5,797,368 | A * | 8/1998 | Kreuter | F02D 13/023 123/308 |
| 10,767,520 | B1 | 9/2020 | Hattiangadi et al. | |
| 2019/0323420 | A1 | 10/2019 | Hotta et al. | |

OTHER PUBLICATIONS

International Search Report and Written Opinion of the International Searching Authority for International application No. PCT/EP2021/057940 dated Dec. 21, 2021.

* cited by examiner

*Primary Examiner* — Jacob M Amick
*Assistant Examiner* — Charles J Brauch
(74) *Attorney, Agent, or Firm* — Carlson, Gaskey & Olds, P.C.

(57) ABSTRACT

The combustion chamber inlet of a lean-burn gasoline engine (110) is connected to an air intake port outlet (15*a*, 15*b*) and comprises a throat where the air intake port (10) outlet meets the combustion chamber inlet. A movable valve (51) comprises a bottom surface (61) that faces the combustion chamber (50) and a tapered top surface (62) that faces the air intake port (10). The movable valve (51) is arranged to move between a closed state for closing off the combustion chamber inlet and an opened state wherein intake air can flow from the air intake port (10) into the combustion chamber (50). The throat comprises a tapered surface (71) that is complementary with the tapered top surface (62) of the movable valve (51).

10 Claims, 5 Drawing Sheets

AIR INTAKE FOR A LEAN-BURN GASOLINE ENGINE

TECHNICAL FIELD

The present disclosure relates to a lean-burn gasoline engine and to a vehicle with such an engine.

BACKGROUND

In classic internal combustion engines, gasoline burns best when it is mixed with air in the proportions of 14.7:1 (lambda=1). Most modern gasoline engines used in vehicles tend to operate at or near this so-called stoichiometric point for most of the time. Ideally, when burning fuel in an engine, only carbon dioxide (CO2) and water (H2O) are produced. In practice, the exhaust gas of an internal combustion engine also comprises significant amounts of carbon monoxide (CO), nitrogen oxides ($NO_x$) and unburned hydrocarbons. It is desirable to increase fuel efficiency and reduce unwanted emissions.

One possible route for increasing fuel efficiency is to burn the fuel with an excess of air. Burning fuel in such an oxygen-rich environment is usually called lean-burning. Typical lean-burn engines may mix air and fuel in proportions of, for example, 20:1 (lambda>1.3) or even 30:1 (lambda>2). Advantages of lean-burn engines include, for example, that they produce lower levels of CO2 and hydrocarbon emissions by better combustion control and more complete fuel burning inside the engine cylinders. The engines designed for lean burning can employ higher compression ratios and thus provide more efficient fuel use and lower exhaust hydrocarbon emissions than conventional gasoline engines. Additionally, lean-burn modes help to reduce throttling losses, which originate from the extra work that is required for pumping air through a partially closed throttle. When using more air to burn the fuel, the throttle can be kept more open when the demand for engine power is reduced.

Lean burning of fuel does, however, also come with some technical challenges that have to be overcome to provide an engine that is suitable and optimised for efficiently burning hydrocarbons in an oxygen-rich environment. For example, if the mixture is too lean, the engine may fail to combust. At low loads and engine speeds, reduced flammability may affect the stability of the combustion process and introduce problems with engine misfire. A lower fuel concentration also leads to less power output. Because of such disadvantages, lean burn is currently only used for part of the engine map and most lean-burning modern engines, for example, tend to cruise and coast at or near the stoichiometric point.

In order to enable the lean burning of fuel over a larger portion of the engine map, the engine needs to be designed in such a way to enable a large air flow into the combustion chamber and to ensure a reliable combustion process that will effectively burn all fuel, despite the oxygen rich conditions.

It is an aim of the present invention to provide an improved lean-burn engine.

SUMMARY OF THE INVENTION

Aspects and embodiments of the invention provide a lean-burn engine and a vehicle with such an engine. The lean-burn engine may be suitable for use with gasoline as described herein.

Alternatively or in addition thereto it will be appreciated that the lean-burn engine may be suitable for use with other fuels, such as hydrogen, for example. Aspects and embodiments of the invention are defined in the context of lean-burn gasoline but it will be appreciated that the fuel type can be substituted.

According to an aspect of the present invention there is provided a lean-burn gasoline engine comprising an air intake port, a combustion chamber, and a movable valve. The air intake port comprises an air intake port inlet, an air intake port outlet, and an air channel connecting the air intake port inlet to the air intake port outlet. The combustion chamber comprises a combustion chamber inlet which is connected to the air intake port outlet, the combustion chamber inlet having a throat where the air intake port outlet meets the combustion chamber inlet. The movable valve comprises a bottom surface that faces the combustion chamber and a tapered top surface that faces the air intake port. The movable valve is arranged to move between a closed state for closing off the combustion chamber inlet and an opened state wherein intake air can flow from the air intake port into the combustion chamber. The throat comprises a tapered surface that is complementary with the tapered top surface of the movable valve.

As in other lean-burn engines, one of the aims of the currently proposed design of the air intake systems is to take in large volumes of air. In addition thereto, the lean-burn gasoline engine according to the invention is configured to direct this high volume intake air flow in such a way as to create and promote a 'tumble' motion. This tumble motion causes the incoming air to first flow along a roof of the combustion chamber towards the opposite side of the chamber. There, the air flow goes down along the rear wall to finally move up towards the air inlet, along the wall nearest to the air inlet of the combustion chamber. This tumble is preferably kept in motion during the full intake stroke and at least a portion of the compression stroke of the piston moving through the combustion chamber.

The complementary tapered surfaces of the intake valve and the throat together ensure that during the compression stroke, when the intake valve is closed, no or little air can get trapped behind the valve or between the valve and an inner surface of the combustion chamber while tumbling through the combustion chamber.

Preferably, the tapered surface of the throat and the tapered top surface of the movable valve are configured such that when the movable valve is in its closed position, the movable valve at least partially sinks into the throat. The further the valve is allowed to sink into the throat, the less disturbance it can cause to the desired tumble. In an embodiment of the invention, the bottom surface of the movable valve may even be substantially flush with an inner surface of the combustion chamber when the movable valve is in its closed position.

Due to the tapered surface of the throat, and because the valve needs to be able to close off the air inlet, the diameter of the combustion chamber inlet is smaller than the valve diameter. The valve diameter is determined by the bottom surface of the valve. In an embodiment of the invention, the diameter of the combustion chamber inlet is less than, e.g., 95% or 90% of a diameter of the bottom surface of the movable valve. Not only does this allow for the desired taper in the throat surface, the protruding upstream portion of the throat also helps to shield of the valve edge, thereby directing the air flow over the top surface of the valve and along the roof of the combustion chamber instead of around the valve edge and down along the wall closest to the combustion chamber inlet. This effect can further be enhanced by the protruding upstream portion ending with a sharp edge that promotes detachment of the air flow. The terms upstream and downstream are herein used to refer to parts of the air intake port relative to flow of air through the air intake port in its normal use with a lean-burn gasoline engine. The predominant air flow direction is from an upstream position to a downstream position. It follows that in normal use the engine is downstream of the air intake port.

In a preferred embodiment, a deflector is provided at an inner wall of the combustion chamber and protruding radially therefrom, the deflector being positioned underneath an outer edge of the bottom surface of the movable valve. This deflector is arranged such that an air flow moving up along the inner wall of the combustion chamber is deflected radially inward and away from the outer edge of the bottom surface of the movable valve. As a result, the risk of any air being trapped behind the valve when in a closed or almost closed position is reduced. This useful deflector, on top of that, brings the additional advantage that during the intake stroke, when the valve is at least partially open and air is drawn into the combustion chamber, any air unintentionally bouncing of the top surface of the valve will be prevented from flowing down along the nearest inner wall of the combustion chamber. Instead, the deflector will block this astray air flow back into the chamber, and in the direction of the desired tumble.

In a preferred embodiment of this lean-burn gasoline engine, the air intake port and the valve are arranged such that when the valve is in its opened position, the complete bottom surface of the valve is positioned below the air intake port. This allows the separated air flow leaving the air intake port to flow along the roof of the combustion chamber and towards the opposite chamber wall with minimal disturbance by the valve it has to pass.

In a preferred embodiment, the air intake port and the valve are arranged such that even when the valve is half-way between its closed position and its opened position, the complete bottom surface of the valve is positioned below the air intake port. This further allows reduced flow disturbance by the valve while the valve is still opening, thereby facilitating the creation of the desired tumble as soon as the valve is opened. In alternative embodiments, the complete front valve face drops below the air intake port when the valve is, e.g., 60% open.

In a further embodiment, the air intake port and the valve are arranged such that when the valve is in its opened position, also the complete top surface of the valve is positioned below the air intake port, with the tapered angle of the top surface at a similar angle as the port floor, which leads to even less disturbance of the air flow, and helps to direct the air flow across the top of the chamber, with a more prominent and stable tumble as a result. The top surface may be inclined slightly upward at the point where the air flow may hit the valve in order to lift the air flow up in the direction of the chamber ceiling and/or the top end of the opposing wall.

Preferably, the throat provides a sharp edge with the channel floor, such as to promote a separation of an incoming air flow from a combustion chamber wall. Without this sharp edge, there is a risk of the incoming air flow adhering to the combustion chamber wall and bending down the corner against the direction of the desired tumble. The sharp edge helps the air flow to continue in the flow direction it has at the end of the air channel and to be launched in a direction along the roof of the combustion chamber. To further increase the desired tumble motion, the throat may provide a smooth edge with the channel ceiling, such as to adhere an incoming air flow to a combustion chamber ceiling. It is noted that the throat is a circular opening that has an interface with the channel floor as well as with the channel ceiling. If a continuous circular opening that can be machined in a single cut is preferred, a compromise may need to be found between the sharpness of the edge near the air channel floor and the smoothness of the edge near the air channel ceiling.

According to yet another aspect of the invention, a vehicle is provided comprising a lean-burn gasoline engine as described above.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION

Figure 1:
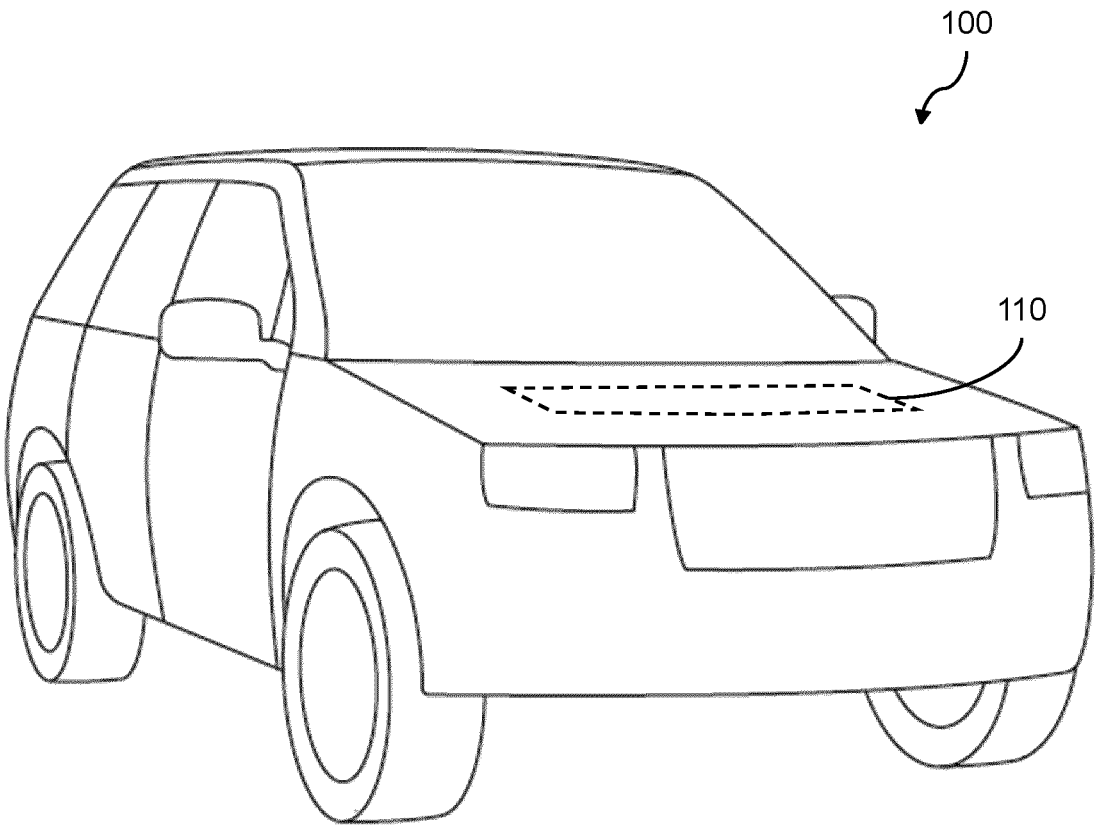
FIG. 1 shows a vehicle in which the invention may be used.

FIG. 1 shows a vehicle 100 in which the invention may be used. In this example, the vehicle 100 is a car, but the invention is equally applicable to other vehicles driven by a lean-burn gasoline engine 110. As mentioned above, it is to be noted that air intake port according to the invention and as described herein can be advantageously used in engines burning other fuels or fuel mixtures than gasoline. For example, the air intake port would be useful in a hydrogen burning internal combustion engine. In this vehicle 100, the lean-burn gasoline engine 110 is positioned in the front and coupled to a drivetrain to drive the front and/or rear wheels of the vehicle 100. The energy needed for driving the vehicle 100 is provided by burning fuel in the engine's cylinders causing the cylinder pistons to drive a crankshaft that is mechanically connected to the vehicle's drivetrain.

Compared to classic internal combustion engines, the lean-burn engine 110 of this vehicle 100 burns the fuel with an excess of air in the air-fuel mixture. Lean-burn engines may mix air and fuel in proportions of, for example, 20:1 (lambda>1.3) or even 30:1 (lambda>2). Advantages of lean-burn engines include more efficient fuel use and lower exhaust hydrocarbon emissions than conventional gasoline engines.

Figure 2:
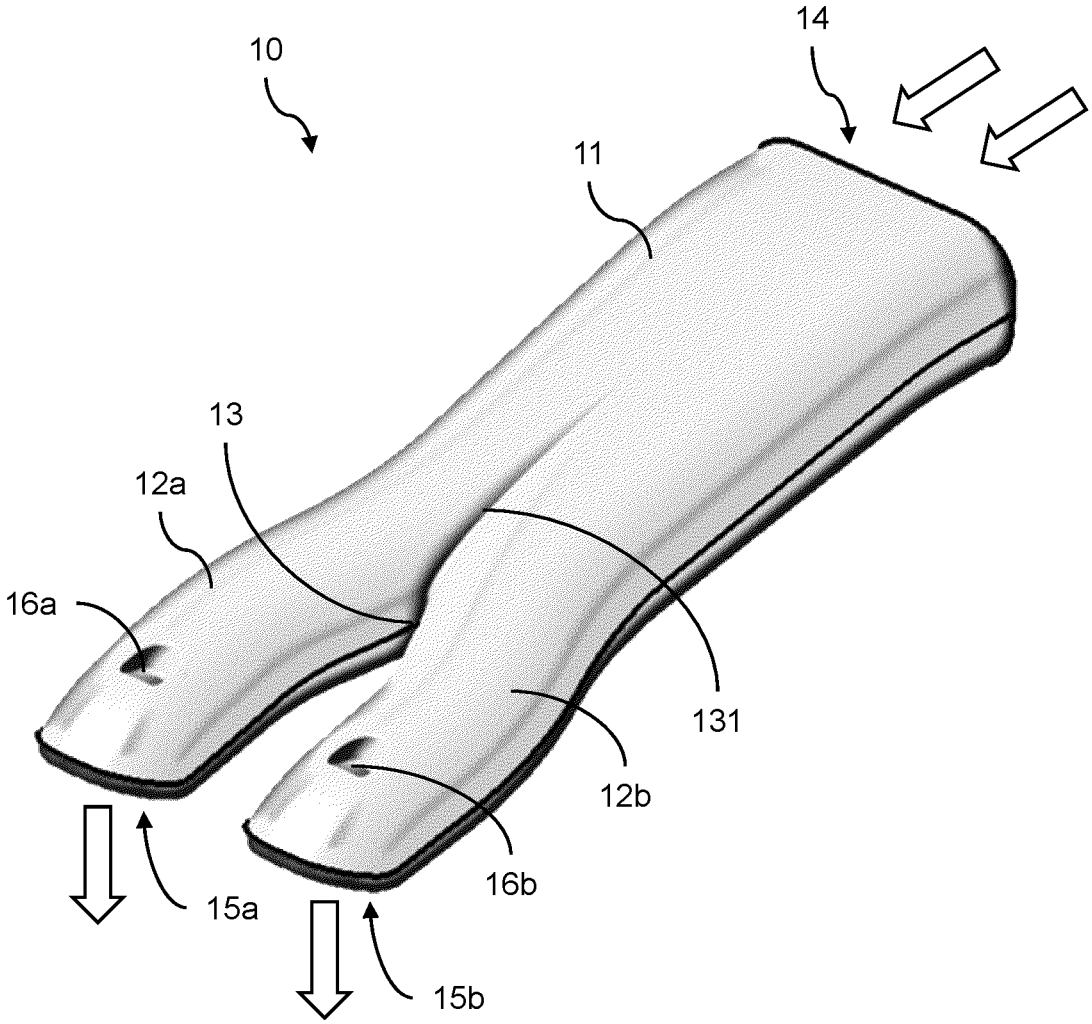
FIG. 2 shows an air intake port according to an embodiment of the invention.

FIG. 2 shows an air intake port 10 according to an embodiment of the invention. The air intake port 10 has an air inlet 14 and two air outlets 15*a*, 15*b*. An air channel connects the air inlet 14 to the two air outlets 15*a*, 15*b*. The first, upstream portion of the air channel, starting at the air inlet 14 forms a common duct 11. Ata bifurcation point 13, at a downstream end of the common duct 11, the common duct 11 branches off in two port legs 12*a*, 12*b* that provide the two respective air outlets 15*a*, 15*b*. The terms upstream and downstream are used to refer to parts of the air intake port 10 relative to flow of air through the air intake port 10 in its normal use with a lean-burn gasoline engine 110. The predominant air flow direction is from an upstream position to a downstream position. It follows that in normal use the engine 110 is downstream of the air intake port 10. The air outlets 15*a*, 15*b* are configured to connect to two respective inlets of the combustion chamber. Near the downstream ends of the port legs 12*a*, 12*b*, two valve guides 16*a*, 16 are provided, each being configured to receive a valve stem that is used for controlling the valve that selectively opens and closes the combustion chamber inlets.

Figure 3:
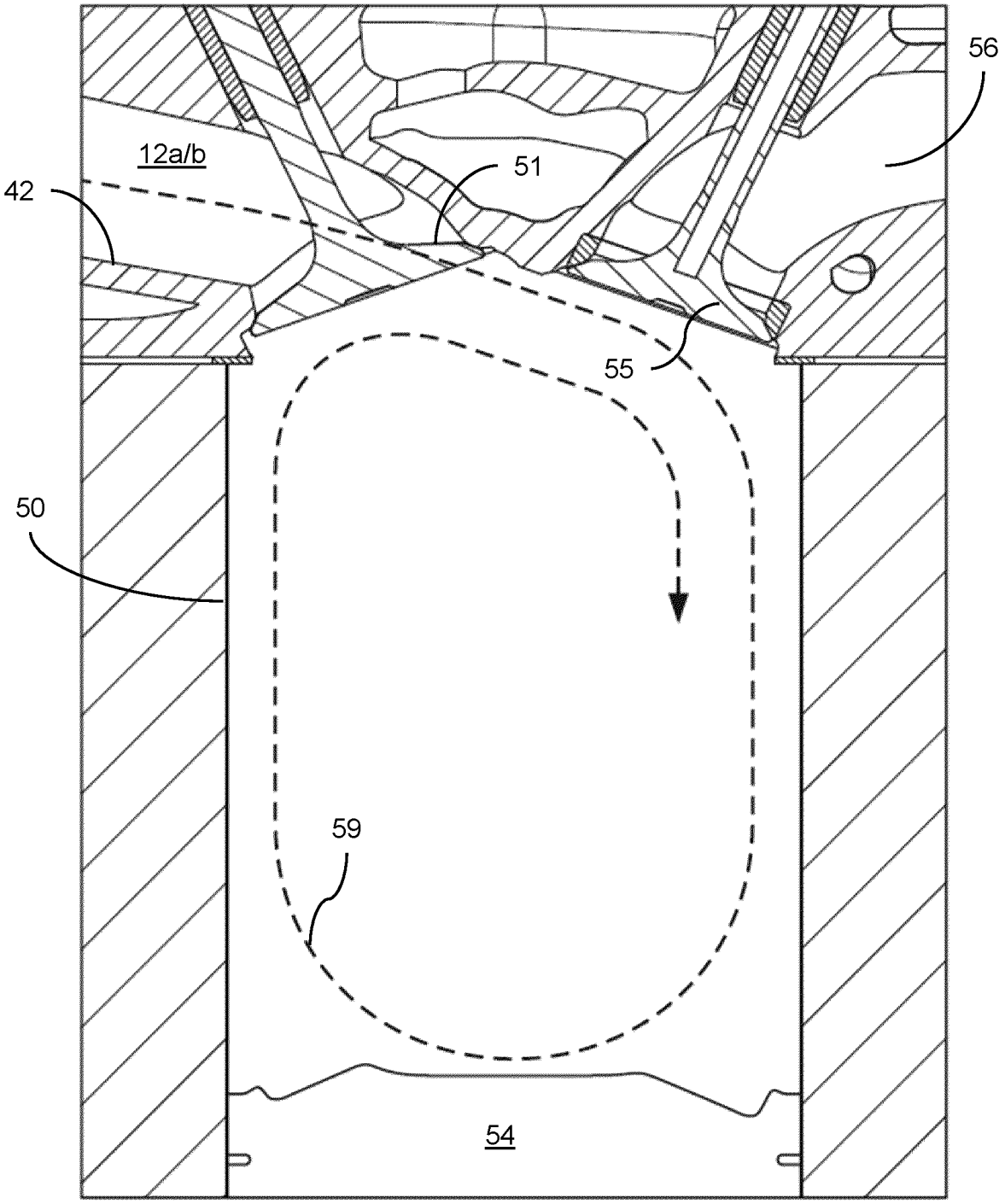
FIG. 3 shows a cross section of a combustion chamber with a retracted piston and a closed inlet valve.

FIG. 3 shows a cross section of a combustion chamber 50 with a retracted piston 54 and a closed inlet valve 51. A dotted line 59 provides a simplified 2D representation of the preferred air flow into and through the combustion chamber 50. It is noted that the air flow into the combustion chamber 50 is not possible with a closed inlet valve 51 but is shown for the purpose of illustration only. shows a cross section of a combustion chamber 50 with a retracted piston 54 and a closed inlet valve 51.

With the valve 51 and air inlet design of this embodiment, it is possible to create a tumble motion of the incoming air, first along the roof of the combustion chamber 50 towards the opposite wall, under the outlet valve 55 that closes off the exhaust outlet 56, and then down along that opposing wall, back over the top surface of the piston 54 and up along the combustion chamber wall in the direction of the inlet valve 51 again. This tumble is preferably kept in motion during the full intake stroke and at least a portion of the compression stroke of the piston 54 moving through the combustion chamber 50. The thus produced tumble helps to obtain an optimal distribution of air and fuel inside the combustion chamber 50 that can then break down into turbulence to facilitate the subsequent combustion process.

In order to create the desired tumble, the valve 51 and the air inlet of the combustion chamber are designed such that the air flow entering the combustion chamber 50 is promoted to detach from the floor of the port leg 12*a*, 12*b* of the air intake port 10 and to flow along the ceiling of the combustion chamber 50. Some of the specific design features that can help to promote the desired tumble are discussed below with reference to FIGS. 4, 5*a*, and 5*b*.

Figure 4:
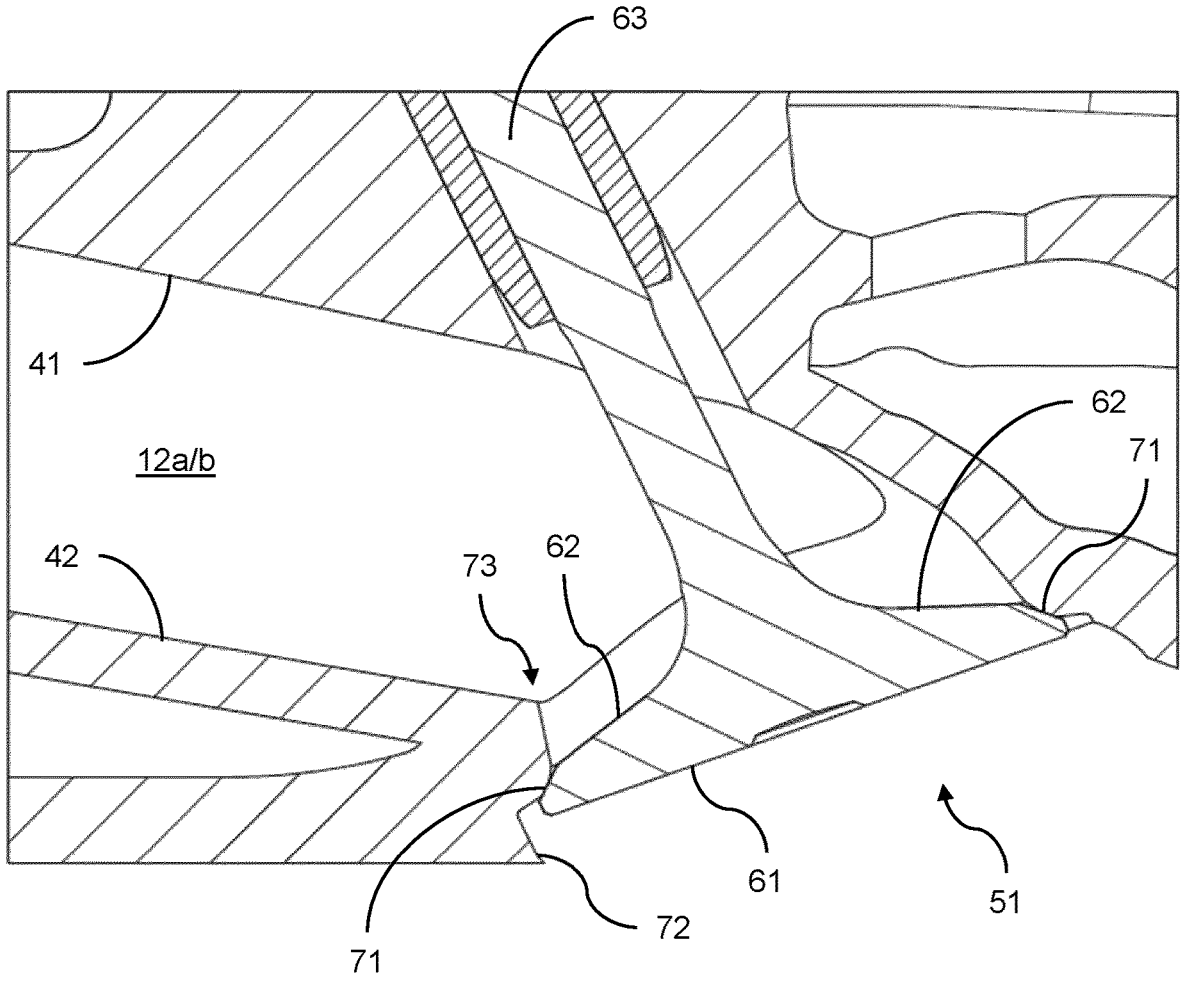
FIG. 4 shows a close-up of the inlet valve of FIG. 3.
Figure 5A:
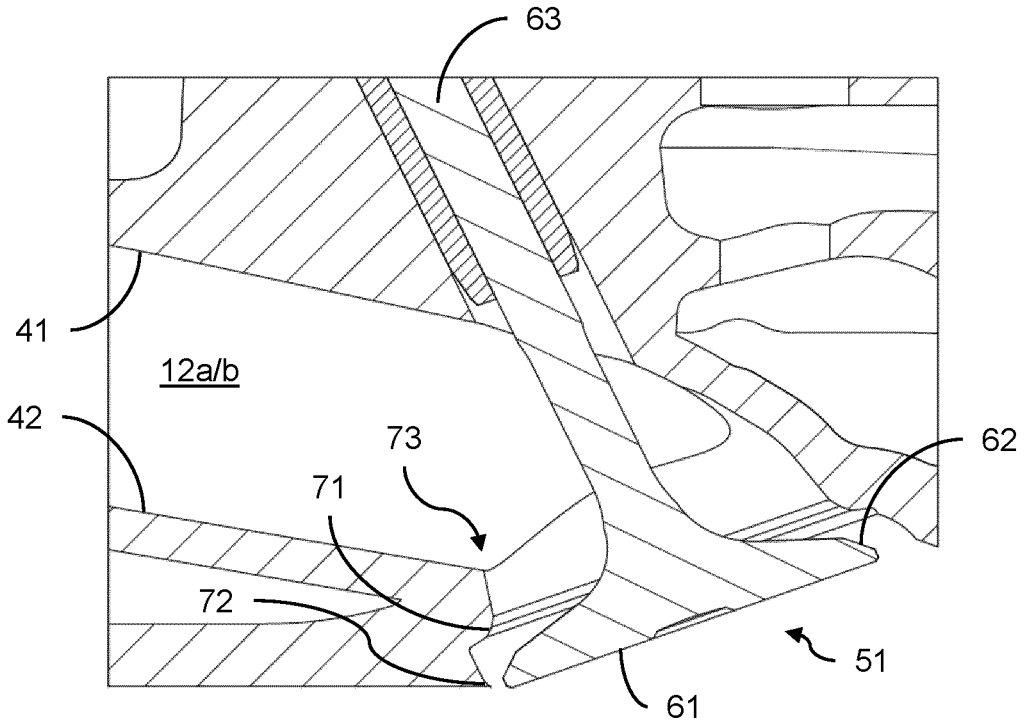
FIG. 5*a* shows the inlet valve of FIG. 4 in a partially opened position.
Figure 5B:
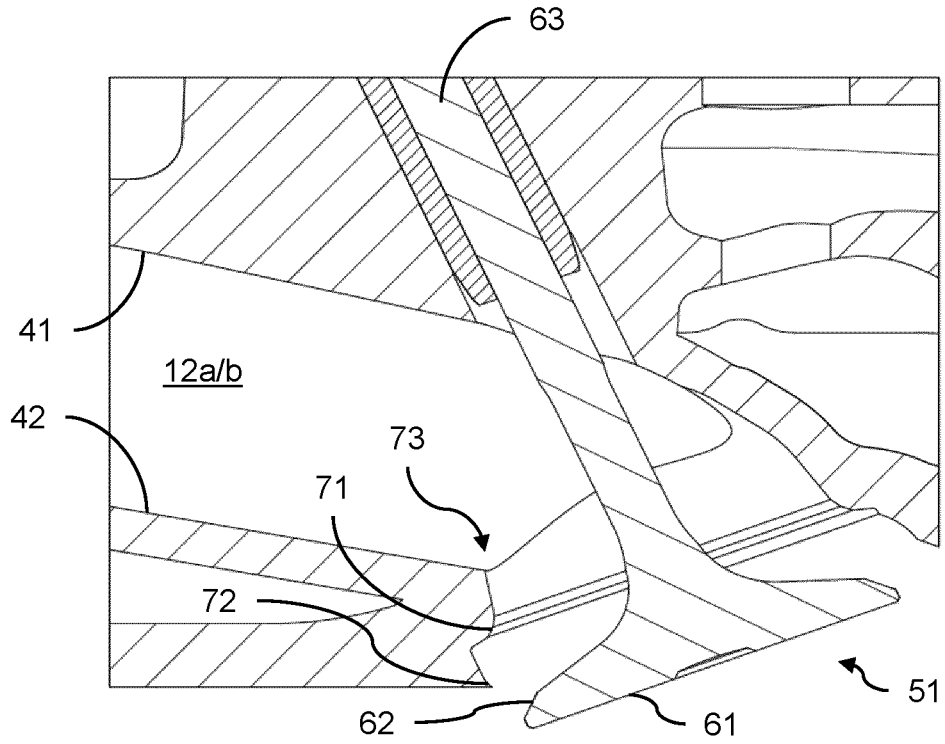
FIG. 5*b* shows the inlet valve of FIGS. 4 and 5*a*, in a more open position.

FIGS. 4, 5*a*, and 5*b* shows a close-up of the inlet valve 51 of FIG. 3. As can be seen in all these Figures, the air channel floor 42 of the port leg 12*a*, 12*b* is flat in the full region up to the air outlet 15*a*, 15*b* of the air intake port 10. The flat air channel floor 42 promotes the detachment of the air flow as soon as it leaves the air intake port 10 and enters the combustion chamber 50, which contributes to the desired tumble.

The movable valve 51 comprises a bottom surface 61 that faces the combustion chamber 50 and a tapered top surface 62 that faces the air intake port 10. The inlet valve 51 is provided at the end of a valve stem 63. This inlet valve 51 is arranged to move by controlling the position of the valve stem 63. The movable valve 51 may be moved between a closed state (FIG. 4) for closing off the combustion chamber inlet and an opened state (FIGS. 5*a* and 5*b*) wherein intake air can flow from the air intake port 10 into the combustion chamber 50. The throat comprises a tapered surface 71 that is complementary with the tapered top surface 62 of the movable valve 51, such that when the movable valve 51 is in its closed position, the movable valve 51 at least partially sinks into the throat.

This tumble is preferably kept in motion during the full intake stroke and at least a portion of the compression stroke of the piston 54 moving through the combustion chamber 50. The complementary tapered surfaces 62, 71 of the intake valve 51 and the throat together ensure that during the compression stroke, when the intake valve 51 is closed, no or little air can get trapped behind the valve 51 or between the valve 51 and an inner surface of the combustion chamber 50 while tumbling through the combustion chamber 50. The further the valve 51 is allowed to sink into the throat, the less disturbance it can cause to the desired tumble. In an embodiment of the invention, the bottom surface 61 of the movable valve 51 may even be substantially flush with an inner surface of the combustion chamber 50 when the movable valve 51 is in its closed position.

Due to the tapered surface 71 of the throat, and because the valve 51 needs to be able to close off the air inlet, the diameter of the combustion chamber inlet is smaller than the valve diameter. The valve diameter is determined by the bottom surface 61 of the valve 51. In an embodiment of the invention, the diameter of the combustion chamber inlet is less than, e.g., 95% or 90% of a diameter of the bottom surface 61 of the movable valve 51. Not only does this allow for the desired taper 71 in the throat surface, the protruding upstream portion of the throat also helps to shield of the valve edge, thereby directing the air flow over the top surface 62 of the valve 51 (see FIG. 5*a*) and along the roof of the combustion chamber 50 instead of around the valve edge and down along the wall closest to the combustion chamber inlet.

This effect can further be enhanced by the protruding upstream portion ending with a sharp edge 73 that promotes detachment of the air flow. In this example, the sharp edge 73 coincides with the outer end of the air channel floor 42 at the air outlet 15*a*, 15*b* of the air intake port 10. While this is the preferred embodiment, the channel floor 42 may alternatively end at a position in front of or behind the sharp edge 73. In preferred embodiments, the angle between the channel floor 42 and an adjacent portion of the throat is at least 225 degrees. However, angles closer to, or even beyond, 270 degrees are even more preferred. The larger the angle, the smaller the chance that the airflow will adhere to the throat surface and finds a way down into the combustion chamber 50 immediately upon entering.

Additionally, an optional deflector 72 is provided at an inner wall of the combustion chamber and protruding radially therefrom. The deflector 72 is positioned underneath an outer edge of the bottom surface 61 of the movable valve 51. This deflector 72 is arranged such that an air flow moving up along the inner wall of the combustion chamber 50 is deflected radially inward and away from the outer edge of the bottom surface 61 of the movable valve 51. As a result, the risk of any air being trapped behind the valve 51 when in a closed or almost closed position is reduced. This useful deflector 72, on top of that, brings the additional advantage that during the intake stroke, when the valve 51 is at least partially open and air is drawn into the combustion chamber 50, any air unintentionally bouncing of the top surface 62 of the valve 51 will be prevented from flowing down along the nearest inner wall of the combustion chamber 50. Instead, the deflector 72 will block this astray air flow back into the chamber 50, and in the direction of the desired tumble.

In a preferred embodiment of this lean-burn gasoline engine 110, the air intake port 10 and the valve 51 are arranged such that when the valve 51 is in its opened position, the complete bottom surface of the valve 51 is positioned below the air intake port 10. This allows the separated air flow leaving the air intake port 10 to flow along the roof of the combustion chamber 50 and towards the opposite chamber wall with minimal disturbance by the valve 51 it has to pass. In an even more preferred embodiment, the complete bottom surface 61 of the valve 51 is already positioned below the air intake port 10 when the valve 51 is only half-way between its closed position and its opened position. This further allows reduced flow disturbance by the valve 51 while the valve is still opening, thereby facilitating the creation of the desired tumble as soon as the valve 51 is opened. In alternative embodiments, the complete bottom surface 61 drops below the air intake port 10 when the valve is, e.g., 60% open.

In a further embodiment, the air intake port 10 and the valve 51 are arranged such that when the valve 51 is in its opened position, also the complete top surface 62 of the valve 51 is positioned below the air intake port 10, with the tapered angle of the top surface 62 at a similar angle as the port floor, which leads to even less disturbance of the air flow, and helps to direct the air flow across the top of the chamber, with a more prominent and stable tumble as a result. The top surface 62 may be inclined slightly upward at the point where the air flow may hit the valve 51 in order to lift the air flow up in the direction of the chamber ceiling and/or the top end of the opposing wall.

It will be appreciated that various changes and modifications can be made to the present invention without departing from the scope of the present application.

The invention claimed is:

1. A lean-burn gasoline engine comprising:

an air intake port with an air intake port inlet, an air intake port outlet, and an air channel connecting the air intake port inlet to the air intake port outlet, a combustion chamber with a combustion chamber inlet being connected to the air intake port outlet, the combustion chamber inlet having a throat where the air intake port outlet meets the combustion chamber inlet, and a movable valve comprising a bottom surface that faces the combustion chamber and a tapered top surface that faces the air intake port, the movable valve being arranged to move between a closed state for closing off the combustion chamber inlet and an opened state wherein intake air can flow from the air intake port into the combustion chamber, and wherein the throat comprises a tapered surface that is complementary with the tapered top surface of the movable valve, wherein a floor of the air channel is flat up to the throat, and wherein the throat provides a sharp edge with a channel floor of the air channel to separate an incoming air flow from a combustion chamber wall.

2. A lean-burn gasoline engine according to claim 1, wherein the tapered surface of the throat and the tapered top surface of the movable valve are configured such that when the movable valve is in its closed position, the movable valve at least partially sinks into the throat.

3. A lean-burn gasoline engine according to claim 1, wherein the bottom surface of the movable valve is substantially flush with an inner surface of the combustion chamber when the movable valve is in its closed position.

4. A lean-burn gasoline engine according to claim 1, wherein a diameter of the combustion chamber inlet is less than 95% of a diameter of the bottom surface of the movable valve.

5. A lean-burn gasoline engine according to claim 1, wherein a deflector is provided at an inner wall of the combustion chamber and protruding radially therefrom, the deflector being positioned underneath an outer edge of the bottom surface of the movable valve.

6. A lean-burn gasoline engine according to claim 1, wherein the air intake port and the valve are arranged such that when the valve is in its opened position, the complete bottom surface of the valve is positioned below the air intake port.

7. A lean-burn gasoline engine according to claim 6, wherein the air intake port and the valve are arranged such that when the valve is half-way between its closed position and its opened position, the complete bottom surface of the valve is positioned below the air intake port.

8. A lean-burn gasoline engine according to claim 6, wherein the air intake port and the valve are arranged such that when the valve is in its opened position, the complete top surface of the valve is positioned below the air intake port.

9. A lean-burn gasoline engine according to claim 1, wherein the throat provides a smooth edge with a channel ceiling of the air channel, such as to adhere an incoming air flow to a combustion chamber ceiling.

10. A vehicle comprising a lean-burn gasoline engine according to claim 1.

* * * * *